US010378197B2

(12) United States Patent
Kurosawa et al.

(10) Patent No.: US 10,378,197 B2
(45) Date of Patent: Aug. 13, 2019

(54) METHOD FOR JOINTING CONCRETE COLUMN AND IRON BEAM

(71) Applicant: KUROSAWA CONSTRUCTION CO., LTD., Chofu-shi, Tokyo (JP)

(72) Inventors: Ryohei Kurosawa, Tokyo (JP); Shigeru Hyakutake, Tokyo (JP); Hitoyuki Takagi, Tokyo (JP)

(73) Assignee: KUROSAWA CONSTRUCTION CO., LTD., Tokyo (JP)

( * ) Notice: Subject to any disclaimer, the term of this patent is extended or adjusted under 35 U.S.C. 154(b) by 0 days.

(21) Appl. No.: 15/800,718

(22) Filed: Nov. 1, 2017

(65) Prior Publication Data

US 2018/0127966 A1 May 10, 2018

(30) Foreign Application Priority Data

Nov. 4, 2016 (JP) ..... 2016-216206

(51) Int. Cl.

| | |
|---|---|
| ***E04B 1/18*** | (2006.01) |
| ***E04B 1/30*** | (2006.01) |
| ***E04B 1/98*** | (2006.01) |
| ***E04C 5/08*** | (2006.01) |
| ***E04H 9/02*** | (2006.01) |

(Continued)

(52) U.S. Cl.

CPC ..... *E04B 1/185* (2013.01); *E04B 1/30* (2013.01); *E04B 1/98* (2013.01); *E04B 5/29* (2013.01); *E04C 5/0645* (2013.01); *E04C 5/08* (2013.01); *E04H 9/021* (2013.01); *E04H 9/025* (2013.01);

(Continued)

(58) Field of Classification Search

CPC ..... E04H 9/02; E04H 9/021; E04H 9/025; E04H 9/028; E04H 12/12; E04H 12/16; E04B 1/185; E04B 1/30; E04B 2103/02; E04B 2103/06; E04B 1/98; E04B 5/29; E04C 5/012; E04C 3/34; E04C 3/30; E04C 5/0645; E04C 5/08

See application file for complete search history.

(56) References Cited

U.S. PATENT DOCUMENTS

| | | | | |
|---|---|---|---|---|
| 1,969,774 A * | 8/1934 | Bauer | E04B 1/16 52/649.6 |
| 9,765,521 B1 * | 9/2017 | Abbas | E04C 3/26 |
| 2015/0330095 A1 | 11/2015 | Kurosawa | |

FOREIGN PATENT DOCUMENTS

| | | |
|---|---|---|
| JP | 7042727 B * | 5/1995 |
| JP | 2004-92156 | 3/2004 |

(Continued)

OTHER PUBLICATIONS

Notification of Reasons for Refusal dated Mar. 28, 2017 in Japanese patent application No. 2016-216206, with English translation.

*Primary Examiner* — Beth A Stephan
(74) *Attorney, Agent, or Firm* — Wenderoth, Lind & Ponack, L.L.P.

(57) ABSTRACT

A method is provided for jointing a concrete column and an iron beam. A structure joint portion is provided between a column-beam junction and an end of the iron beam, which is mourned on a coning provided to the column. Prestressing tendons are arranged in plural rows to horizontally penetrate the column-beam junction, Tension-introduction forces are applied to the prestressing tendons to tensionally anchor an anchor plate, and thereby to integrally joint the column and the beam.

2 Claims, 6 Drawing Sheets

(51) Int. Cl.
*E04B 5/29* (2006.01)
*E04C 5/06* (2006.01)

(52) U.S. Cl.
CPC ..... *E04B 2103/02* (2013.01); *E04B 2103/06* (2013.01)

(56) References Cited

FOREIGN PATENT DOCUMENTS

| | | | | |
|---|---|---|---|---|
| JP | 5521105 | | | 6/2014 |
| JP | 5612231 | | | 10/2014 |
| JP | 2015004229 | A | * | 1/2015 |

* cited by examiner

METHOD FOR JOINTING CONCRETE COLUMN AND IRON BEAM

Priority is claimed on Japanese Patent Application No. 2016-216206 filed on Nov. 4, 2016, the content of which is incorporated herein by reference.

BACKGROUND OF THE INVENTION

1. Field of the Invention

The present invention is related to a method for jointing a concrete column and an iron beam, or beam of steel structure, in a building structure including the concrete column and the iron beam.

2. Description of the Related Art

The present inventor has proposed a method for jointing a concrete column and an iron beam, which has been disclosed as known art.

The known prior art is a method for jointing a PC column and an iron beam in a building structure. A column-beam junction is integrally formed with a cast-in-place concrete or PC column. An anchor plate is provided at an end of the iron beam, or an end plate is provided at the end and an anchor plate is provided apart from the end with a predetermined distance. The end is mounted and set on a cogging provided with the PC column. A prestressing tendon horizontally penetrates the column-beam junction. It is used for tensional anchoring of the anchor plate to install the iron beam. Another prestressing tendon is provided in the PC column. The prestressing tendon vertically penetrates the column-beam junction. Prestressing tendons in PC columns at upper and lower layers are connected for tensional anchoring of them. The PC columns and the iron beams are integrally jointed by the prestressing tendons penetrating the column-beam junction. See Japanese Patent No. 5521105.

In the method for jointing the column and the beam, a weight of the beam is reduced since it is an iron beam. The cogging is integrally provided to the PC column. This achieves an extensive space with a wide span, or distance between columns. The structure is reasonable, and can be applied to high or super-high buildings. The column-beam junction is integrally formed with the PC column. The structure includes the PC columns with the coggings, and the iron beams. They are tensionally anchored and jointed by the prestressing tendons. Even in the case of a huge earthquake, the iron beam is prevented from dislocation and dropping from the PC column. This enables preservation of an stable joint condition. In spite of the wide span, this enables reasonable and safe joint structure to be achieved with good workability. In the construction, the end of the iron beam can be mounted on the cogging without timbering or the like. Thus, the iron beam can be installed in an independent state. This enables significant reduction of labor and cost of the construction.

SUMMARY OF THE INVENTION

1. Technical Problem

By the way, Japanese Patent No. 5521105 teaches the following. A tension-introduction force applied to the prestressing tendon for installation of the iron beam and the prestressing tendon in the PC column is set as 40 to 60% of yield load of the prestressing tendon. This produces an appropriate margin for extension of the prestressing tendon. The prestressing tendon is deformed within an elastic region without yielding, even if it receives repetitional quakes caused by a huge earthquake. This prevents the PC columns or the ends of the iron beams from being damaged. After the earthquake, the elastic restoration force of the prestressing tendon restores the whole structure including the columns, the beams, and the like, to the original position. No residual deformation harmful to usage remains.

However, in the existing design method, the basic mechanism is to form a yield hinge at the end of the beam at each story of the frame structure in the case of large earthquake, which is a very rare earthquake. This is called beam-yielding preceding type, and is required in the design. Thus, prohibited is the configuration proposed by the inventor in Japanese Patent No. 5521105 to prevent damaging of the columns and the ends of the iron beams. This is a problem in this particular field.

The present invention aims to provide a method for jointing a column and a beam. It prevents yielding of a base material portion of the iron beam, even in the case of a large and very rare earthquake. Further, it enables the whole structure including the column-beam junction to be maintained in a damage-free state.

2. Solution to the Problem

As a specific means for achieving the aim, a first aspect according to the present invention is used in a building structure having a concrete column and an iron beam. A column-beam junction is integrally formed to the column in advance. An anchor plate and an anchorage is provided at an end of the beam, an end plate is provided at an end of the beam and an anchor plate and an anchorage are provided apart from the end of the beam with a predetermined distance, or an end plate, a solidified filler material with a predetermined thickness, and an anchorage are provided at an end of the beam. A structure joint portion is provided between the column-beam junction and the end of the iron beam, which is mounted on a cogging provided to the column. Prestressing tendons are arranged in plural rows to horizontally penetrate the column-beam junction. Tension-introduction forces are applied into the prestressing tendons to tensionally anchor the anchorage, and thereby to integrally joint the column and the beam. A concrete slab with a predetermined thickness is provided on the upper end of the iron beam. In the method for jointing the column and the beam, a joint-separation control condition is set and fulfilled, so as to inhibit joint separation at the structure joint portion in a case of a moderate earthquake, which is a rare earthquake, or weaker, and to allow the joint separation in order to prevent yielding the iron beam in a case of a large earthquake, which is a very rare earthquake. The iron beam is an H-steel with a width B, a plate thickness t of each flange, a yielding strength $\sigma_y$, and a distance $d_s$ between a lower end of the beam and a top end of the slab.

A relation with a resultant force P of the tension-introduction forces of the prestressing tendons on a sectional surface of the end of the beam fulfills an expression:

$$P<d_s/d_{pc}\times T_s,$$

as the joint-separation control condition, where $d_{pc}$ denotes a distance between a position where the resultant force affects and the top end of the slab, and $T_s$ denotes a tensile yield load of the flange at a tensile side of the iron beam and $$T_s=B\times t\times\sigma_y.$$

A second aspect according to the present invention is used in a building structure having a concrete column and an iron beam. A column-beam junction is integrally formed to the column in advance. An anchor plate and an anchorage is provided at an end of the beam, an end plate is provided at an end of the beam and an anchor plate and an anchorage are provided apart from the end of the beam with a predetermined distance, or an end plate, a solidified filler material with a predetermined thickness, and an anchorage are provided at an end of the beam. A structure joint portion is provided between the column-beam junction and the end of the iron beam, which is mounted on a cogging provided to the column. Prestressing tendons are arranged in plural rows to horizontally penetrate the column-beam junction. Tension-introduction forces are applied into the prestressing tendons to tensionally anchor the anchorage, and thereby to integrally joint the column and the beam. A concrete slab with a predetermined thickness is provided on the upper end of the iron beam. In the method for jointing the column and the beam, the tension-introduction forces of the prestressing tendons are different according to rows, so as to inhibit joint separation at the structure joint portion in a case of a moderate earthquake, which is a rare earthquake, or weaker, and to allow the joint separation in order to prevent yielding the iron beam in a case of a large earthquake, which is a very rare earthquake.

3. Advantageous Effects of Invention

The jointing method according to the present invention results in the following effect. At the structure joint portion of the end of the beam, joint separation does not occur in the case of a moderate earthquake, which is a rare earthquake, or weaker. The column and the beam remain in a rigid joint condition. Both of the column and the beam are within an elastic range, and exert aseismatic performance. In the case of a large earthquake, which is a very rare earthquake, the joint is separated in an elastic state. The beam member is rotationally deformed to reduce stress shared by the iron beam. This enables the prevention of yielding of the beam to keep it in a damage-free state. After the earthquake, an elastic restoration force of the prestressing tendon causes the separated joint to fold. The whole structure including the column, the beam and the like is restored to the original position. No residual deformation remains.

In other words, the jointing method of the present invention provides a structure with damage-free columns and beams achieved by elastic separation of the structure joint portion, or a prestressed binding junction between the column and the beam.

Experiments have been performed and the maximum proof stress of the column-beam junction structure according to the jointing method of the present invention is confirmed to largely exceed the design value designed by the existing ultimate strength design method. A structure built by employing the jointing method of the present invention can exert sufficient proof stress and capacity of deformation. It can handle a huge earthquake with seismic intensity 7 or the like.

BRIEF DESCRIPTION OF THE DRAWINGS

FIG. 8A is a side view, and FIG. 8B is another view viewed from a different direction with 90-degree rotation; FIG. 9A shows a case without joint separation, and FIG. 9B shows a case with joint separation.

DETAILED DESCRIPTION OF THE INVENTION

A method for jointing a column and a beam of the present invention will be explained in detail, based on embodiments illustrated in drawings.

Embodiment 1

Figure 1:
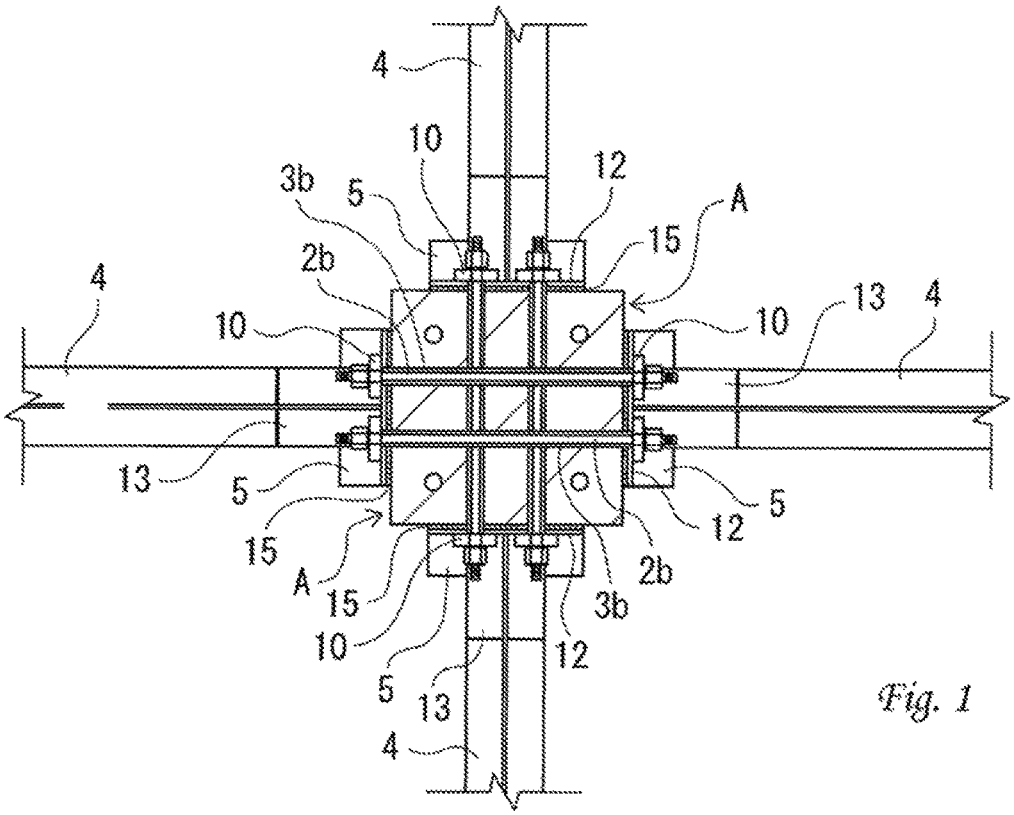
FIG. 1 shows a horizontally sectional plan view illustrating a main part of a column-beam junction structure constructed by a jointing method according to a first embodiment of the present invention.
Figure 2:
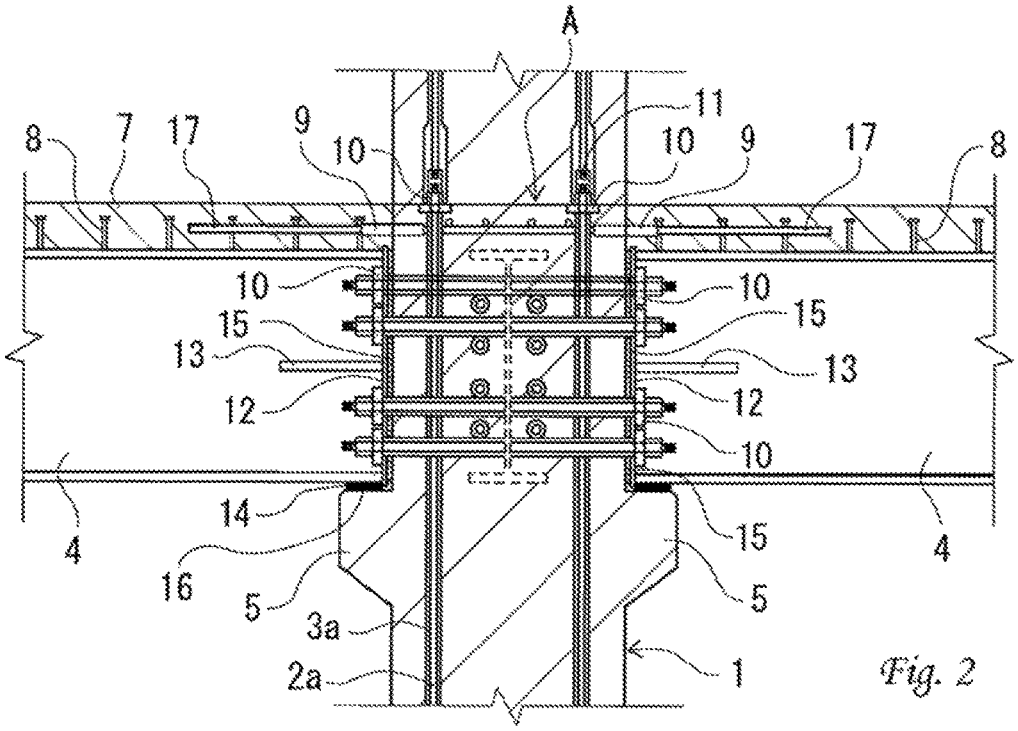
FIG. 2 shows a vertically sectional side view illustrating the main part of the column-beam junction structure constructed by the jointing method according to the embodiment.

Now referring to FIGS. 1 and 2, a first embodiment will be explained. In FIGS. 1 and 2, a column of a building is a precast concrete column 1, hereinafter called PC column. Inside the PC column 1, a plurality of prestressing tendons 2 are disposed in a vertical direction through sheaths 3*a*. Coggings 5 are integrally formed to protrude from column surfaces at sides where iron beams 4 are installed. A column-beam junction A, or a panel zone, is located above the coggings 5, and formed integrally with the column in advance. The column-beam junction A is provided with sheaths 3*b* in a horizontal direction arranged in plural rows in order to connect the iron beams 4. The sheaths 3*a* provided in the vertical direction are provided to penetrate from a lower end of the PC column 1 to an upper end of the column-beam junction A. On an upper end of the iron beam 4, reinforcement fittings 9 is provided along with stud bolts 8 in advance, in order to joint a concrete slab 7.

Although not shown, the PC columns 1 are constructed as one span for one layer, or for one story, and arranged apart from one other with predetermined distances. Lower ends of the prestressing tendons 2 are connected with the foundation of the building structure. The prestressing tendon 2 includes prestressing steel rods 2*a*, each of which is tensionally anchored by fastening with anchorage 10, including a bearing plate and a nut, at an upper part of the PC column 1 for each span. The PC columns 1 are connected at upper parts of the spans in order, and stably kept in an erect state.

In the connection of the PC columns 1, a column of a second span is erected on a column of a first span. The prestressing steel rod 2*a* is disposed in the column of the first span, and is tensionally anchored at an upper part of the first span by the anchorage 10. Its upper end is connected by a coupler 11 to a lower end of a prestressing steel rod 2*a* for the second span. It is tensionally anchored in a erect state at an upper part of the second span column by an anchorage 10, in the same manner as the first span. Subsequently, the same processes are repeated up to the uppermost story, to assemble the PC columns 1. After the prestressing steel rod 2*a* is tensionally anchored, a grout is filled between the prestressing steel rod 2*a* and the sheath 3*a* to achieve a bond type with rustproofing.

At an end of the iron beam 4, an anchor plate 12 is provided and integrally jointed by welding, for example. In order to more rigidly joint and integrate the anchor plate 12 with the iron beam 4, it is preferable to provide and connect a reinforcing member 13 between the anchor plate 12 and the iron beam 4 by welding. The iron beam 4 is installed on the upper part of the assembled PC column 1 for each layer.

The end of the iron beam 4 is mounted via a buffer material 14 on the cogging 5 of the PC column 1 erected as described above. A predetermined gap is provided for a structure joint portion 15 between it and the column-beam junction A. The prestressing tendons 2, such as prestressing steel rods 2*b*, are inserted and set through the horizontal sheaths 3*b*. The structure joint portion 15 is filled with joint mortar, for example. After the joint mortar is solidified, the prestressing steel rods 2*b* is tensionally anchored by fastening with the anchorage 10 including a bearing plate and a nut in the same manner as described above. The PC column 1 and the iron beam 4 are integrated with sandwiching the structure joint portion 15 between the anchor plate 12 and the column-beam junction A. It is preferable to provide a slipping material 16 between the buffer material 14 and the cogging 5. After the prestressing steel rods 2*b* are tensionally anchored, a grout is filled between the prestressing steel rod 2*b* and the sheath 3*b* to achieve a bond type with rustproofing.

Thereafter, a top reinforcing bar 17 is linked to reinforcement fittings 9 provided in advance at a slab position. A concrete slab 7 is formed on the upper end of the iron beam 4 with a predetermined thickness. It is formed by placing a cast-in-place concrete, and integrated with the iron beam 4 and the PC column 1 by stud bolts 8 and the top reinforcing bar 17.

Embodiment 2

Figure 3:
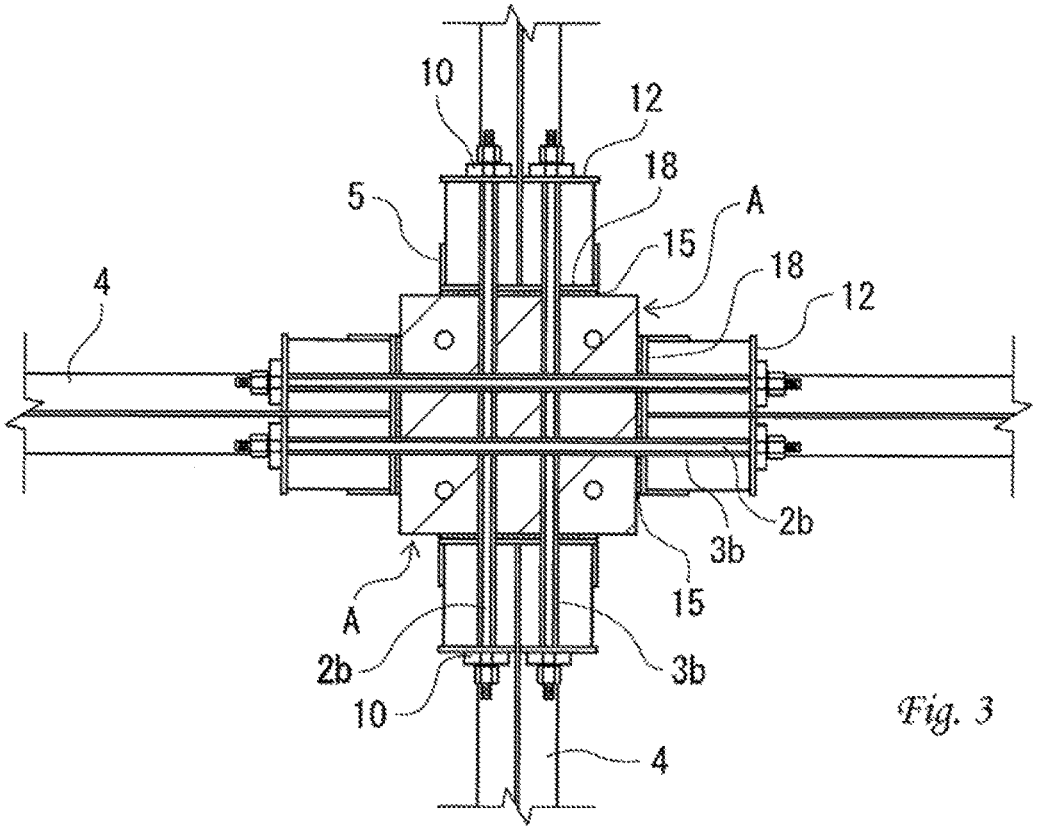
FIG. 3 shows a horizontally sectional plan view illustrating a main part of a column-beam junction structure constructed by a jointing method according to a second embodiment of the present invention.
Figure 4:
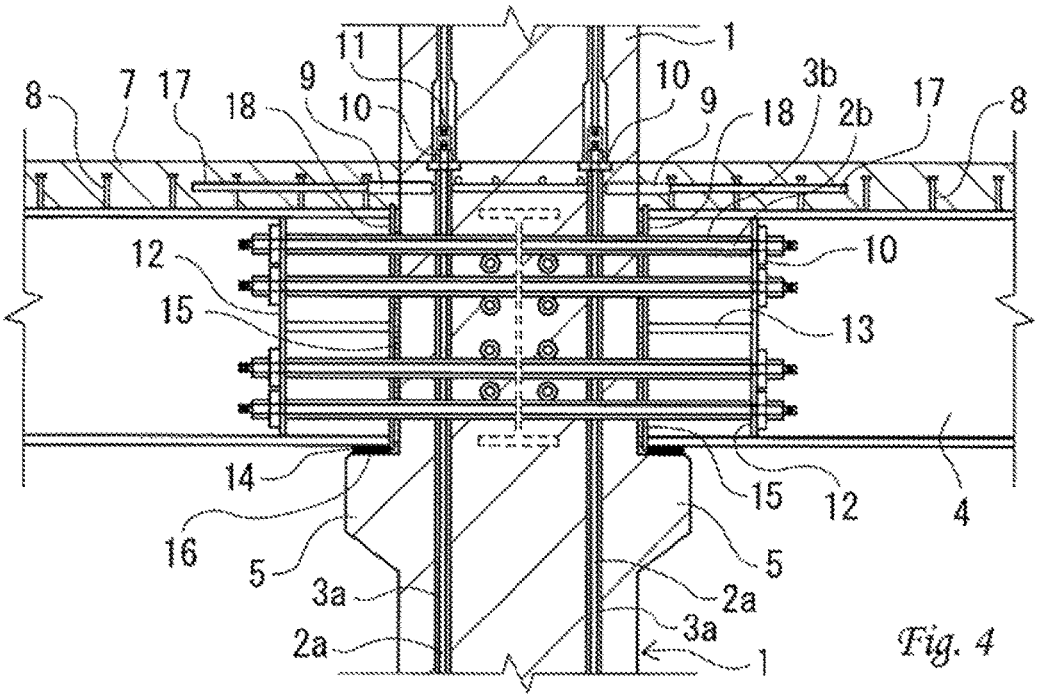
FIG. 4 shows a vertically sectional side view illustrating the main part of the column-beam junction structure constructed by the jointing method according to the embodiment.

Next referring to FIGS. 3 and 4, a second embodiment according to the present invention will be explained. The same signs assigned for substantively the same portions as the first embodiment. Detailed explanation is omitted for avoiding redundancy.

In this embodiment, an end plate 18 is integrally provided at an end of the iron beam 4 by welding. An anchor plate 12 is provided inwards apart from the end of the iron beam 4 with a predetermined distance. A reinforcing member 13 is disposed between the anchor plate 12 and the end plate 18. The reinforcing member 13 is integrally installed among the end plate 18, the anchor plate 12 and the iron beam 4 by welding. The other components are substantively the same as those in the first embodiment.

In this manner, the plates 12, 18 are doubly provided at the end of the iron beam 4. This structure significantly improves flexural rigidity of the iron beam end in comparison with the single-plate, or anchor plate, structure disclosed in the first embodiment. Also, this ensure smooth transmission of bending stress from the beam to the column. It is preferable in cases of long spans and/or heavy loading capacity. In the second embodiment, the structure joint portions 15 on both sides are sandwiched between the column-beam junction A and the respective end plates 18 of the iron beams 4. The end of the prestressing steel rod 2*b* is tensionally anchored between the anchor plates 12 on both sides. This achieves integration of the PC column 1 and the iron beam 4. The end of the iron beam 4 is reinforced by the end plate 18, the anchor plate 12 and the reinforcing member 13. Also, a little extra length of the prestressing steel rod 2*b* increases allowance for elongation, and thereby enlarges extent of unfolding, that is, buffering capacity, of the structure joint portion 15. This enables prevention of damaging the end of the iron beam 4, and the whole building having a very tough structure.

Embodiment 3

Figure 5:
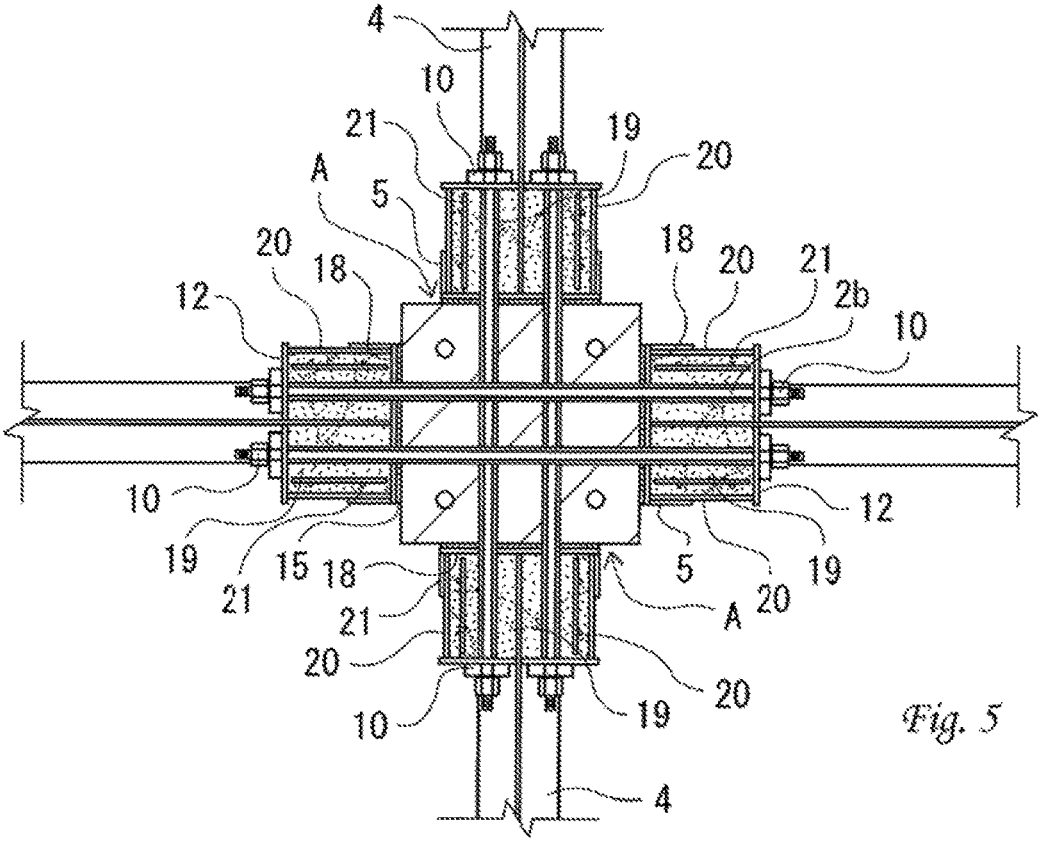
FIG. 5 shows a horizontally sectional plan view illustrating a main part of a column-beam junction structure constructed by a jointing method according to a third embodiment of the present invention.
Figure 6:
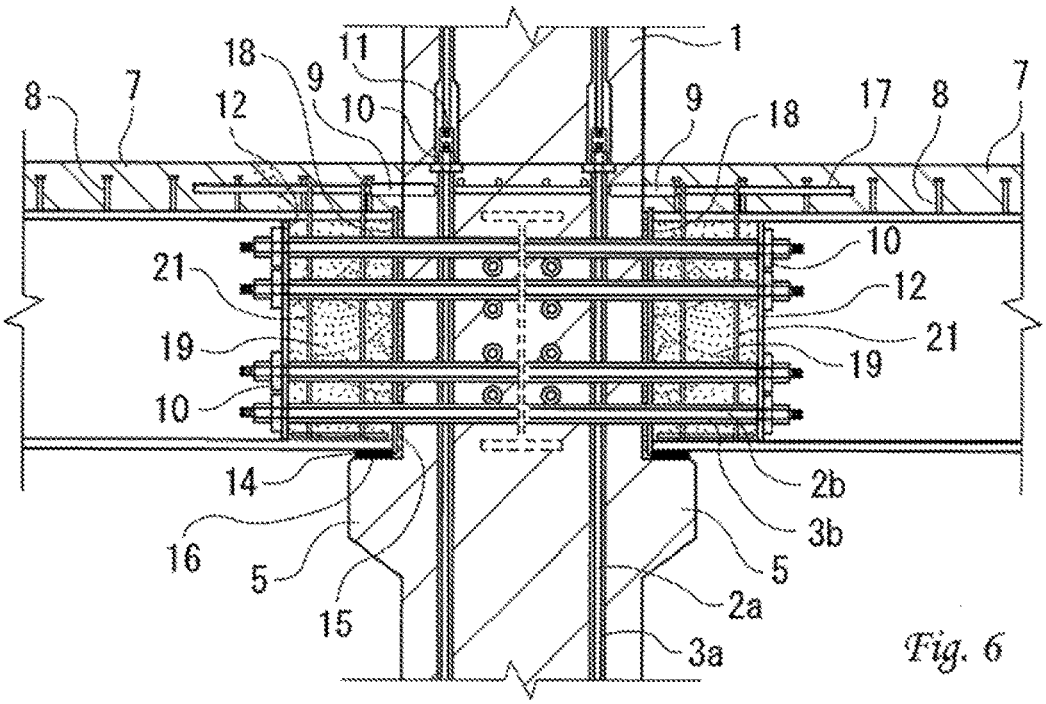
FIG. 6 shows a vertically sectional side view illustrating the main part of the column-beam junction structure constructed by the jointing method according to the embodiment.

Referring now to FIGS. 5 and 6, a third embodiment according to the present invention will be explained. The third embodiment substantively employs the basic components according to the first and second embodiments. The same reference signs are assigned for the same portions. A detailed explanation is omitted in order to avoid redundancy.

In this embodiment, an appropriate filler material 19, such as concrete or mortar, for example, is filled between the doubled plates 12, 18 according to the second embodiment. This further improves the flexural rigidity of the iron beam end. Also, this ensures smooth transmission of the bending stress from the iron beam 4 to the PC column 1. Thereby, high toughness is exerted in cases of long spans and/or buildings with heavy loading capacities. The other components are substantively the same as those of the second embodiment.

When the filler material 19 is filled between the end plate 18 and the anchor plate 12 provided at the end of the iron beam 4, a side board 20 may be provided between the doubled plates 12, 18 to enclose them except an upper surface. Required reinforcing bars 21 may be arranged among the enclosed doubled plates. Parts of the reinforcing bars 21 may be exposed to an upper position, where the slab 7 will be formed, and may be bound with the top reinforcing bar 17. The concrete may be placed along with that for slab 7.

In this manner, the filler material 19 is filled between the doubled plates 12, 18. This significantly reduces stress applied to the anchor plate 12, and makes it possible to relatively decrease thicknesses of the end plate 18 and the anchor plate 12. Also, this relieves stress applied to these plates and the welded portion, and thereby makes it possible to prevent breakage of the welded portion and the like.

Embodiment 4

Figure 7:
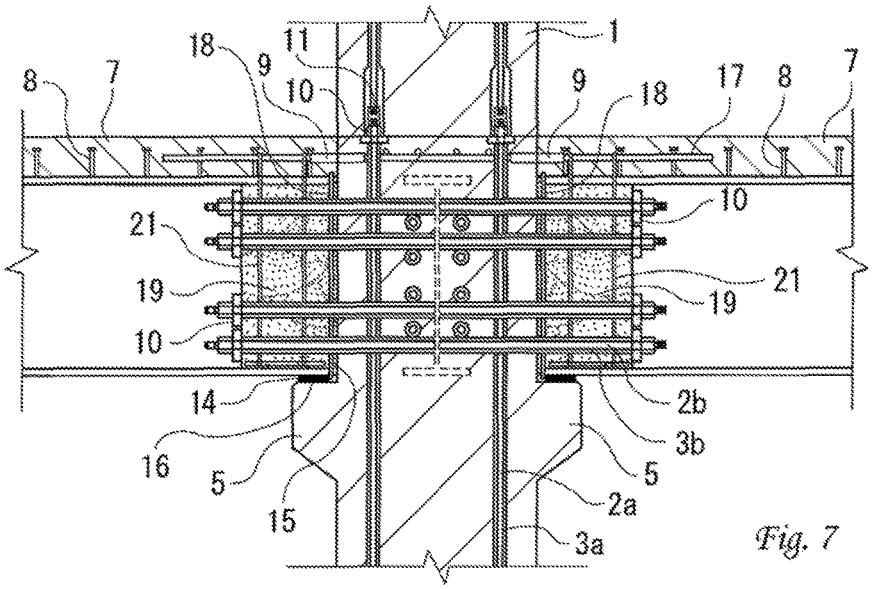
FIG. 7 shows a vertically sectional side view illustrating a main part of a column-beam junction structure constructed by a jointing method according to a fourth embodiment of the present invention.

Now referring to FIG. 7, a fourth embodiment will be explained.

A method for jointing a column and a beam according to the fourth embodiment is a simplified and improved version of the third embodiment. An end plate 18 is provided at an end of an iron beam 4, but an anchor plate is omitted for simplification. The other structures are the same as those of the third embodiment. Detailed explanation is omitted for avoiding redundancy by assigning the same signs. In other words, plural horizontal sheaths 3*b* are disposed in a block of solidified filler material 19. The respective prestressing tendons 2*b* are inserted through them. The end of the prestressing tendon 2*b* is tensionally anchored by fastening the anchorage 10 outside a surface of the block of the filler material 19.

In this manner, the configuration is different from that of the third embodiment, but there is no substantive difference in joint strengths between the column and the beam. Especially, forming the block of the filler material 19 adjacent to the end plate 18 requires only to form an enclosing box shape with wood boards, and to dispose plural horizontal sheaths 3*b*. This produces good workability, and reduces cost since no anchor plate is used. It is tensionally anchored by fastening with the anchorage 10 on a surface. For example, the prestressing steel rod 2*b* is inserted and set through it.

The preferable examples having basic configurations of the present invention are illustrated above. However, arrangement of reinforcing bars or the like is not shown in parts, such as the column and the slab, having no association with the basic configurations of the present invention.

It is preferable that the column is constructed by binding precast concrete columns with prestress. This is called precast and prestressed concrete. However, no limitation is intended. It may be constructed with cast-in-place prestressed concrete. Also, it may be constructed with precast reinforced concrete or cast-in-place reinforced concrete. In other words, any concrete column is possible, so long as it is formed to have a column-beam junction A with a cogging 5, before an iron beam is installed.

The columns illustrated in the examples are middle columns having four column-beam junctions A at all sides. No other columns in a building structure are illustrated, such as outer peripheral columns, which are columns having column-beam junctions A at three sides, or corner columns, which are columns having column-beam junctions A at two sides. However, they can be formed in the similar manner. In other words, they are different from the illustrated ones in the examples in that an iron beam exists on one side of the column and there is no configuration for anchoring ends of prestressing tendons on the opposite side surface. The ends of the prestressing tendon can be anchored with appropriate anchorage 10 or the like. The other components can be the same as those of the examples.

Figure 8A:
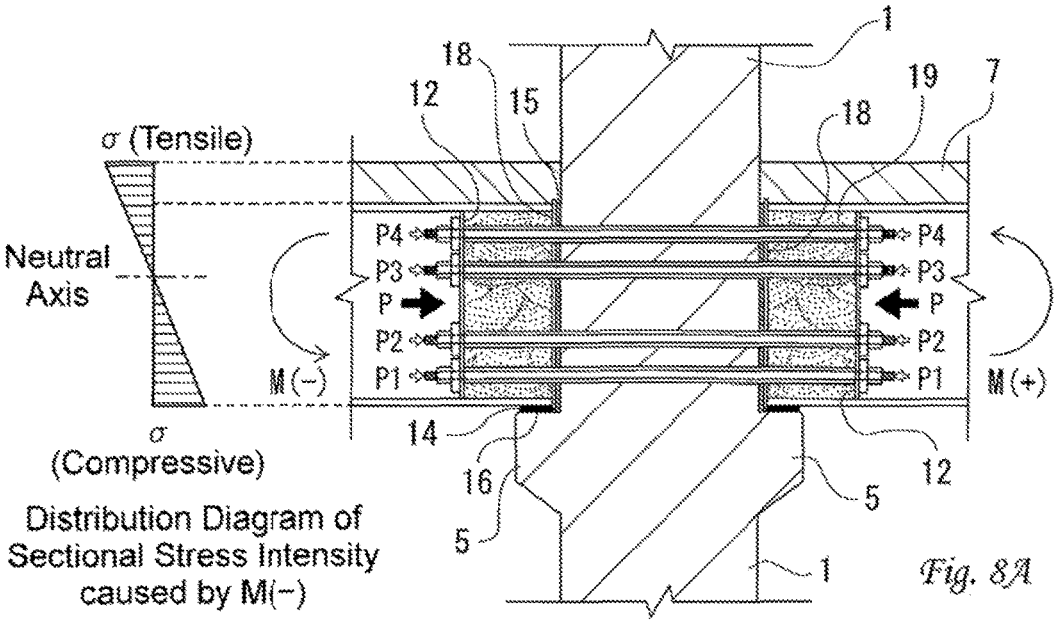
FIGS. 8A and 8B illustrates the column-beam junction structure constructed by the jointing method according to the third embodiment, which represents the embodiments of the present invention, in order to explain a joint-separation control condition.
Figure 8B:
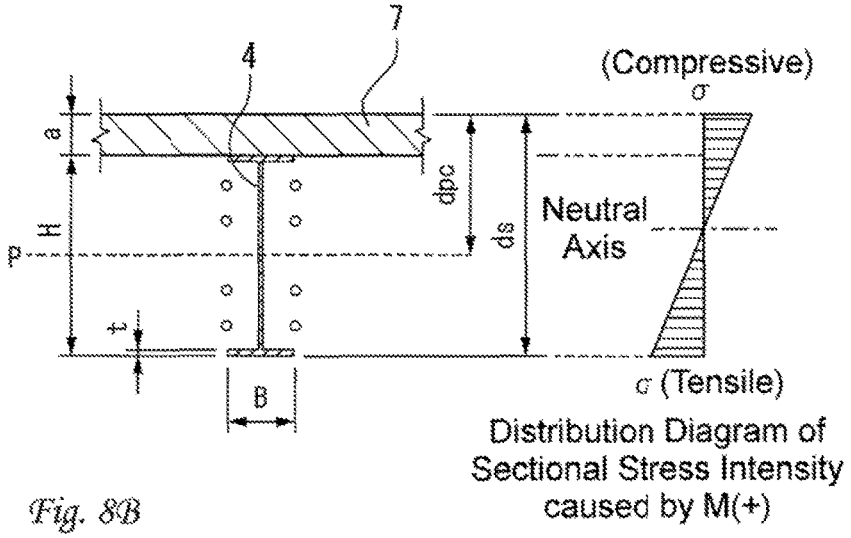

Next referring to FIGS. 8A and 8B, details of the jointing method of the present invention is specifically illustrated.

In order to ease understanding, parts are omitted and not illustrated, having no association with the basic configuration, such as top reinforcing bars, stud bolts, or the like. The iron beam 4 is H-steel. The H-steel has a width B, a plate thickness t of the flange, a height H, and a yielding strength σ. A cast-in-place concrete slab 7 is provided on the upper end of the iron beam 4 to be integrated with the iron beam 4 and thereby to be a composite beam. The slab has a thickness a, and a distance $d_s$ from the lower end of the iron beam 4 to the top end of the slab.

The doubled-plate 12, 18 structure is formed at the end of the iron beam 4. The filler material 19, such as concrete, is filled between the doubled plates. Prestressing tendons penetrate the column-beam junction A to joint the iron beams 4 of both sides, and are arranged in four rows. Each of the rows includes two prestressing steel rods 2*a*. The tension-introduction forces $P_1$, $P_2$, $P_3$, and $P_4$ is applied to the prestressing steel rods 2*a* for respective rows. The resultant force of them is denoted by P, where $P=\Sigma P_i$, i=1 to 4.

In the section of the end of the beam, a distance between a position where the resultant force of the prestressing tendons affects and the top end of the slab is denoted by $d_{pc}$.

Generally, bending moments affecting the beam ends located at left and right sides of the column in a case of earthquake have opposite directions and the same magnitudes. In FIGS., the bending moments caused by force of the earthquake are illustrated by signs M(−) at the left side and M(+) at the right side. A distribution diagram beside them shows sectional stress intensity of the beam ends caused by the bending moments.

As shown in FIG. 8A, it can be understood from the distribution diagram of the sectional stress intensity for M(−) that sectional stress intensity affects the composite beam, which is a beam obtained by compositing the iron beam and the concrete slab, as tensile one at the upper end and as compressive one at the lower end. Edge stress intensity, which means the largest stress intensity, at the tensile side occurs at a side of an effective width of the concrete slab. Since the top end of the flange of the iron beam is nearer to a neutral axis than the top end of the slab, the tensile stress intensity affecting the top end of the flange is a little smaller. In comparison, as shown in FIG. 8B, when a bending moment M(+) having the same magnitude affects the beam end at the right side, tensile edge stress intensity occurs at the lower end of the beam end, which is at the lower flange plate of the H-steel. This causes the earlier yielding of the iron beam end at the right side.

This is the reason why the problem to be solved by the present invention is prevention of yielding of the iron beam at the right side. For this purpose, a joint-separation control condition is defined to control joint separation.

The joint-separation control condition is to satisfy the expression:

$$P<d_s/d_{pc}\times T_s,$$

where $$d_s=H+a,$$

$T_s=B\times t\times\sigma_y$, which denotes the tensile yield load of the flange at the tensile side of the iron beam, $P=\Sigma P_1$, where i=1, . . . , n (illustrated is a case of n=4), and $d_{pc}$ denotes the distance from the position where the resultant force of the prestressing tendons affects on the section of the beam end, to the top end of the slab.

Next referring to the scheme shown in FIGS. 9A and 9B, action and effect by controlling structure joint separation will be explained.

Figure 9A:
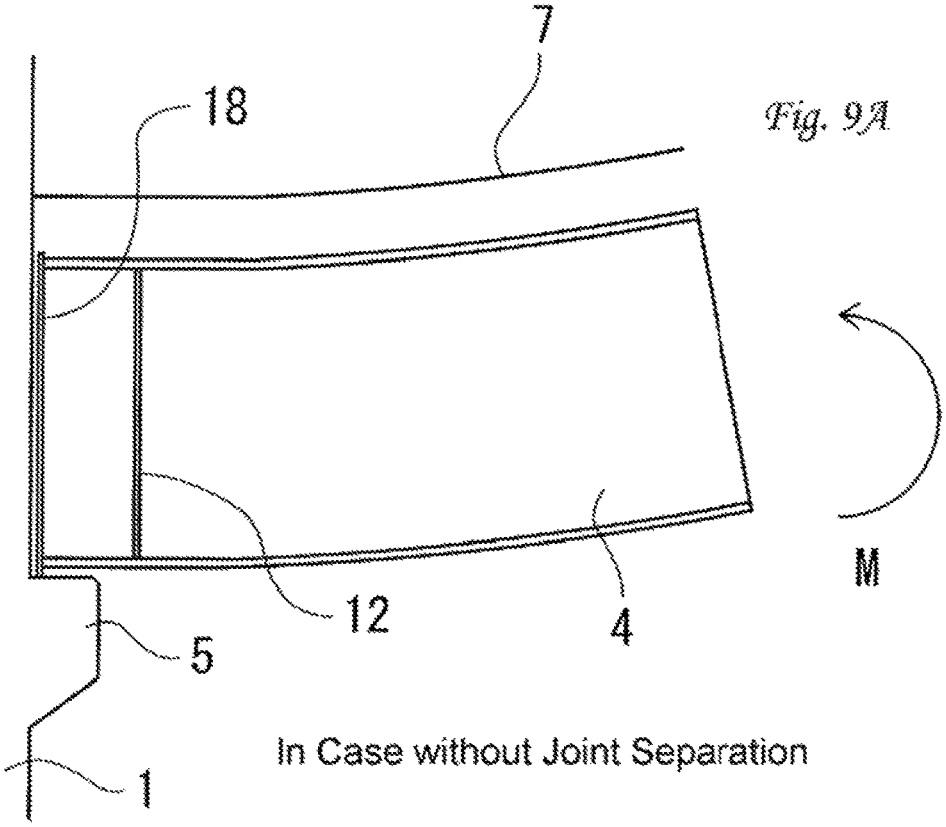
FIGS. 9A and 9B illustrates a scheme of bending deformation of the iron beam in the column-beam junction structure constructed by the jointing method according to the embodiment.

Assume that no joint separation occurs as shown in FIG. 9A in a case of a large earthquake, which is a very rare earthquake. This occurs in the existing design method. The bending moment creates large tensile stress intensity affecting the lower flange plate of the iron beam 4, which is thereby subjected to bending deformation resulting in yielding.

Figure 9B:
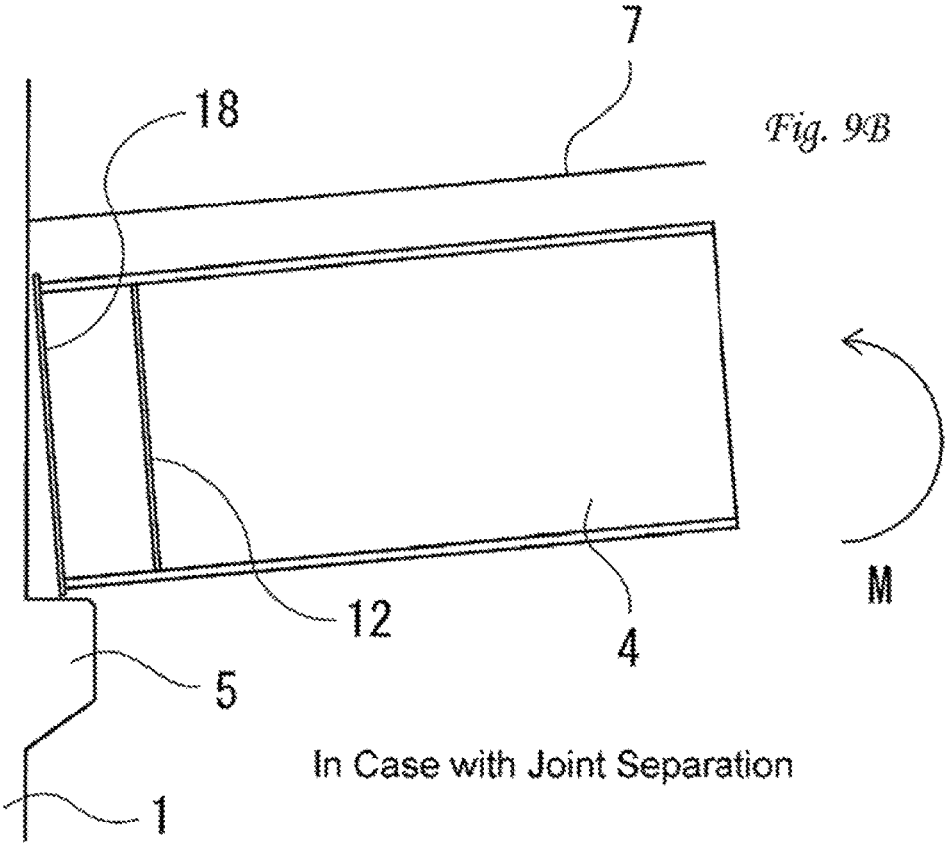

In comparison, the jointing method of the present invention controls structure joint separation in a case of a large earthquake, as shown in FIG. 9B. This almost eliminates bending deformation of the lower flange plate of the iron beam 4, and thereby significantly reduces stress shared by the iron beam 4.

It should be noted that a little unfolding of the joint separation is actually enough to exert the effect. The illustration shows only a scheme.

The prestressing tendons 2 penetrating the column-beam junction to joint the column and the beam may be tensionally anchored in an unbonded form. The prestressing tendons 2 tensionally anchored in an unbonded form is easy to extend in a case of a large earthquake. This is more effective because the joint separation is more easy in cooperation with the existence of the slipping material 16.

The unbonded type can be formed, for example, by using prestressing steel rods plated or coated with epoxy resin, and by filling no grout between the prestressing steel rods and sheaths. Also, usual prestressing steel strands for unbonded type covered with polyethylene can be used. In this case, no filling of grout is needed.

The tension-introduction forces applied to the prestressing tendons may be different according to rows. For example, the resultant force of the prestressing tendons 2 is the same as that in a case that the tension-introduction forces are the same. The tension-introduction force applied to the nearest prestressing tendon to the tensile side is the smallest. It becomes large as it comes near the compressive side. This facilitates the joint separation. Since the resultant force of all of the prestressing tendons is not changed, the designed prestressing force can be introduced as usual.

Therefore, it is preferable in the present invention that tension-introduction force applied to the prestressing tendons 2 nearest to the lower end of the iron beam 4 is 30% or less of yield load of the prestressing tendons 2, tension-introduction force applied to the prestressing tendons 2 nearest to the slab side is 60% of yield load of the prestressing tendons 2, and tension-introduction force applied to the middle prestressing tendons 2 is from 40% to 50% of yield load of the prestressing tendons 2.

The above described embodiments are not intended to limit components or object of the present invention. Various changes can be performed without deviation from the object of the present invention.

A method for jointing a concrete column and a iron beam according to the present invention is used in a building structure having a column and a beam. A column-beam junction A is integrally formed to the column in advance. An anchor plate 12 and an anchorage 10 is provided at an end of the beam, an end plate 18 is provided at an end of the beam and an anchor plate 12 and an anchorage 10 are provided apart from the end of the beam with a predetermined distance, or an end plate 18, a solidified filler material 19 with a predetermined thickness, and an anchorage 10 are provided at an end of the beam. A structure joint portion 15 is provided between the column-beam junction A and the end of the iron beam 4, which is mounted on a cogging 5 provided to the column. Prestressing tendons 2 are arranged in a plurality of rows to horizontally penetrate the column-beam junction A. Tension-introduction forces are applied into the prestressing tendons 2 to tensionally anchor the anchorage 10, and thereby to integrally joint the column and the beam. A concrete slab 7 with a predetermined thickness is provided on the upper end of the iron beam 4. In the method for jointing the column and the beam, a joint-separation control condition is set and fulfilled, so as to inhibit joint separation at the structure joint portion 15 in a case of a moderate earthquake, which is a rare earthquake, or weaker, and to allow the joint separation in order to prevent yielding the iron beam 4 in a case of a large earthquake, which is a very rare earthquake. At the structure joint portion of the end of the beam, joint separation does not happen in the case of a moderate earthquake, which is a rare earthquake, or weaker. The column and the beam remain in a rigid joint condition. Both of the column and the beam are within an elastic range, and exert aseismatic performance. In the case of a large earthquake, which is a very rare earthquake, the joint is separated in an elastic state. The beam member is rotationally deformed to reduce stress shared by the iron beam. This enables the prevention of yielding of the beam to keep it in a damage-free state. After the earthquake, an elastic restoration force of the prestressing tendon causes the separated joint to fold. The whole structure including the column, the beam and the like is restored to the original position. No residual deformation remains. The disclosed invention can be widely applied or utilized to these types of buildings.

REFERENCE SIGNS LIST

1: PC column; 2: prestressing tendon; 2*a*, 2*b*: prestressing steel rod; 3*a*, 3*b*: sheath; 4: iron beam; 5: cogging; 7: concrete slab; 8: stud bolt; 9: reinforcement fitting; 10: anchorage; 11: coupler; 12: anchor plate; 13: reinforcing member; 14: buffer material; 15: structure joint portion; 16: slipping material; 17: top reinforcing bar; 18: end plate; 19: filler material; 20: side board; 21: reinforcing bar; and, A: column-beam junction.

We claim:

1. A method for jointing a concrete column and a iron beam in a building structure having the column and the beam, the beam being an iron beam formed of H-steel, the method comprising:

forming a column-beam junction integrally to the column in advance;

providing an anchor plate and an anchorage at an end of the beam, providing an end plate at an end of the beam and an anchor plate and an anchorage at a predetermined distance apart from the end of the beam, or providing an end plate, a solidified filler material with a predetermined thickness, and an anchorage at an end of the beam;

providing a structure joint portion between the column-beam junction and the end of the beam;

mounting the end of the beam on a cogging provided to the column;

arranging prestressing tendons in plural rows to horizontally penetrate the column-beam junction;

applying tension-introduction forces into the prestressing tendons to tensionally anchor the anchorage, and thereby to integrally joint the column and the beam; and providing a concrete slab with a predetermined thickness on an upper end of the beam, wherein the tension-introduction forces applied into the prestressing tendons are determined so as to fulfill the following conditions:

joint separation at the structure joint portion is inhibited in a case of a moderate earthquake, which is a rare earthquake, or weaker;

the joint separation is allowed to proceed in a case of a large earthquake, which is a very rare earthquake; and yielding of a lower flange of the iron beam is prevented in the case of the large earthquake, by fulfilling an expression:

$$P<d_s/d_{pc}\times T_s,$$

where

P denotes a resultant force P of the tension-introduction forces, $d_s$ denotes a distance between a lower end of the beam and a top end of the slab, $d_{pc}$ denotes a distance between a position where the resultant force affects and the top end of the slab, $T_s$ denotes a tensile yield load of the lower flange of the iron beam and $$T_s = B \times t \times \sigma_y,$$

B denotes a width of the lower flange, t denotes a plate thickness of the lower flange, and $\sigma_y$ denotes a yielding strength of the iron beam.

2. A method for jointing a concrete column and a beam in a building structure having the column and the beam, the beam being an iron beam formed of H-steel, the method comprising:

forming a column-beam junction integrally to the column in advance;

providing an anchor plate and an anchorage at an end of the beam, providing an end plate at an end of the beam and an anchor plate and an anchorage at a predetermined distance apart from the end of the beam, or providing an end plate, a solidified filler material with a predetermined thickness, and an anchorage at an end of the beam;

providing a structure joint portion between the column-beam junction and the end of the beam;

mounting the end of the beam on a cogging provided to the column;

arranging prestressing tendons in plural rows to horizontally penetrate the column-beam junction;

applying tension-introduction forces into the prestressing tendons to tensionally anchor the anchorage, and thereby to integrally joint the column and the beam; and providing a concrete slab with a predetermined thickness on an upper end of the beam, wherein the tension-introduction forces applied into the prestressing tendons are determined so as to fulfill the following conditions:

joint separation at the structure joint portion is inhibited in a case of a moderate earthquake, which is a rare earthquake, or weaker;

the joint separation is allowed to proceed in a case of a large earthquake, which is a very rare earthquake; and yielding of a lower flange of the iron beam is prevented in the case of the large earthquake, by the tension-introduction force applied into the prestressing tendon in a lower-most row being the smallest, the tension-introduction force applied into the prestressing tendon in an upper-most row being the largest, and the tension-introduction force applied into the prestressing tendons increasing at each respective prestressing tendon between the lower-most row and the upper-most row.

* * * * *